United States Patent [19]

Kobayashi

[11] Patent Number: 5,074,235

[45] Date of Patent: Dec. 24, 1991

[54] ANCHOR RETRIEVING DEVICE

[76] Inventor: Satoru Kobayashi, 33-8 Taishido 5-chome, Setagaya-ku, Tokyo-to, 154, Japan

[21] Appl. No.: 652,944

[22] Filed: Feb. 8, 1991

[30] Foreign Application Priority Data

Feb. 10, 1990 [JP] Japan ..... 2-30719

[51] Int. Cl.[5] ..... B63B 21/46

[52] U.S. Cl. ..... 114/299

[58] Field of Search ..... 114/297, 299, 310, 210; 294/66.1, 82.33

[56] References Cited

U.S. PATENT DOCUMENTS 4,721,054 1/1988 Kobayashi ..... 114/299

4,836,126 6/1989 Kobayashi ..... 114/297

*Primary Examiner*—Jesûs D. Sotelo

*Attorney, Agent, or Firm*—Laff, Whitesel, Conte & Saret

[57] ABSTRACT

An improved anchor retrieving device adapted to be attached at an intermediate position of a main anchoring line. The device comprises a lock assembly comprising a gripper detachably mounted on an intermediate position of the main anchoring line, and a lock lever having a lower part swingingly supported by the lower portion of the gripper and an upper part releasably held by the gripper; a connection line for connecting the lock lever to one end of the shank opposite to the crown end of the anchor; and a weight for impinging the lock assembly to change the same from the locking condition to the unlocking condition. The condition line has a connection line retainer for fixing the connection line to the lock lever in the locking condition, and is released from the lock lever when the lock assembly is impinged by the weight. The restrainer is a rope clip fixed to the main anchoring line to engage the bottom of the gripper in one embodiment, or a clamping arrangement for clamping the gripper and simultaneously for fixing the gripper in situ.

9 Claims, 4 Drawing Sheets

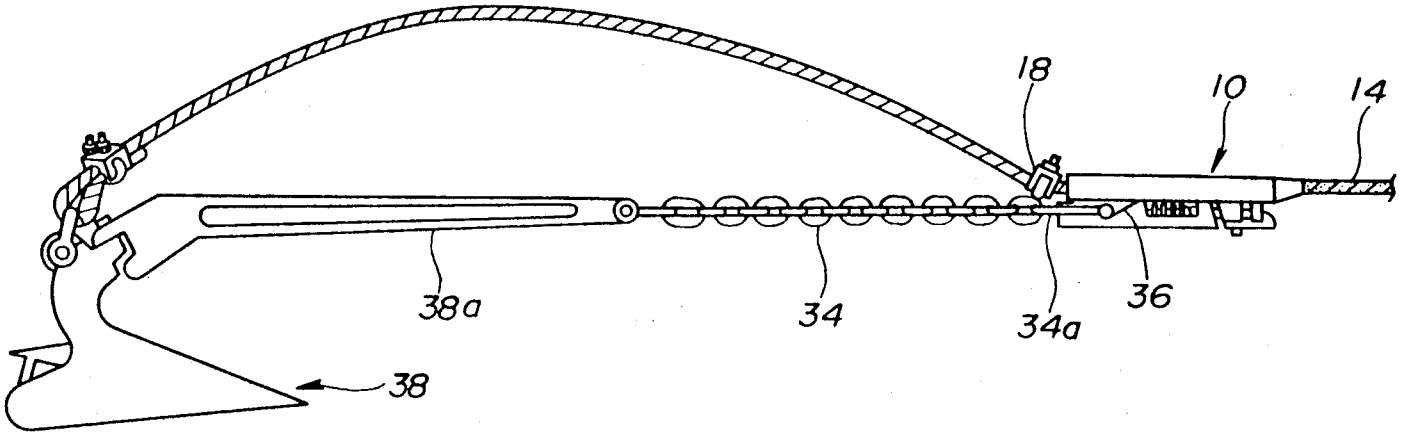
FIG. 4
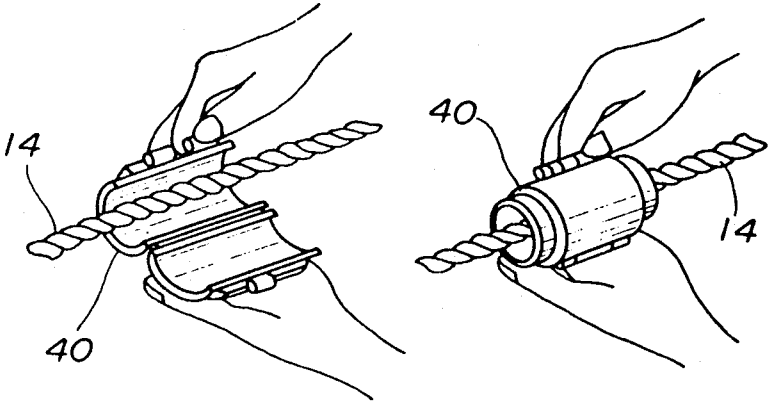
FIG. 6A
FIG. 6B
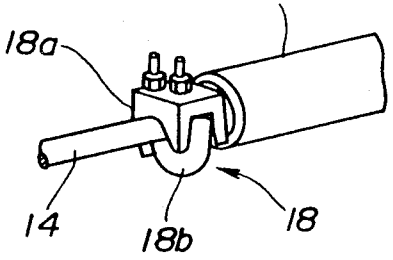
FIG. 5

ANCHOR RETRIEVING DEVICE

BACKGROUND OF THE INVENTION

1. Field of the Invention

The present invention relates generally to an improvement in or relating to anchors, and particularly to an improved anchor retrieving device to be attached to a main anchoring line to retrieve an anchor when it becomes snagged at the bottom of a body of water, for example, seized by roots or ledges of rocks or submerged timbers or like.

2. Related Art Statement

It might often arise a case where an anchor becomes snagged by roots, rocks or like to make it impossible to raise the anchor to the boat or ship. In order to release the anchor and to bring the same in condition for easy raising, I have previously proposed an anchor arrangement. The anchor arrangement according to my previous proposal, comprises a flexible rope having a free end, retaining device for detachably retaining the free end of the rope and being attached to the rope and normally held at a position separated from the free end of the rope by a certain distance, an anchor attached to the rope and having a shank and at least one grasping means (fluke in one embodiment) extending backwardly from one end of the shank for grasping a rock at the bottom of a body of water. The shank of the anchor is attached to the rope so that the one end formed with the fluke is positioned remoter from the free end of the rope. The arrangement further comprises means for opening the retaining device so that the free end of the rope is released therefrom in readiness for the anchor raising operation, upon impingement or striking by a weight.

The anchor arrangement of my prior proposal is disclosed in Japanese Patent Application No. 115232/1985 (corresponding to Japanese Patent Laid-Open Publication No. 275085/1986, U.S. Pat. No. 4,721,054 and European Patent No. 0206530B1). This is also disclosed in my co-pending Japanese Patent Appln. No. 173924/1986 (Japanese Patent Laid-Open Publication No. 31892/1988). The specification of the aforementioned U.S. Pat. No. 4,721,054 will be incorporated herein as a reference.

A similar anchor retrieving device is disclosed in U.S. Pat. No. 4,836,126 and European Patent Publication No. 0297703A which were filed while claiming a convention Priority based on Japanese Patent Appln. No. 151368/1987 (Japanese Patent Laid-Open Publication No. 315395/1988) and matured to patents.

The anchor retrieving device disclosed in U.S. Pat. No. 4,836,126 comprises a lock assembly having a releaseable hook member having one end normally locked by the lock assembly and the other end normally housed in the lock assembly at a position adjacent to the lower end of the lock assembly, the other end being connected through a connection line to the end of the shank opposite to the crown end. The crown end of the shank is connected through an anchor-retrieving line to the housing of the lock assembly. In the normal anchoring position, the anchoring power is transmitted from the end of the shank opposite to the crown end through the connection line and the releaseable hook member to the main anchoring line; and when it is desired to retrieve the anchor from the snagged condition, the lock assembly is struck by a weight to release the releaseable hook member from the lock assembly to disconnect the connection line so that the anchor is raised by the anchor-retrieving line connected between the lower end of the lock assembly and the crown end of the shank. The specification of the aforementioned U.S. Pat. No. 4,836,126 will be incorporated herein as a reference.

However, the anchor retrieving device of my prior proposal has a disadvantage that two lines, namely the connection line and the anchor-retrieving line, must be provided in addition to the main anchoring line to complicate the assembling operation, since these lines must be connected at respective connection points. It has a further disadvantage that the member struck by the weight is an upper crossing member which has a general shape of a balance having arms protruding to be struck simultaneously by the weight. The construction and assembly thereof is rather complicated to reduce the production efficiency of the entire device.

OBJECTS AND SUMMARY OF THE INVENTION

The object of this invention is to overcome the aforementioned disadvantages of the anchor retrieving device of the prior-made proposal.

In particular, the object of this invention is to provide an improved anchor retrieving device which is simple in construction to enable production thereof at higher production efficiency and yet to operate more reliably.

In the improved anchor retrieving device, provided by the invention, a portion of the main anchoring line is used for the anchor-retrieving line instead of the provision of an additional line specifically assembled for transmitting the anchor retrieving force as used in the device of the prior proposal.

Accordingly, the present invention relates to an improvement in the anchor retrieving device to be combined with a main anchoring line for transmitting the anchoring power to an anchor which includes a shank having a crown end and at least one fluke, said anchor retrieving device transmitting the anchoring power from said main anchoring line to the end of said shank opposite to said crown end when it is held in the locking condition and transmitting the anchor raising power from said main anchoring line to said crown end when it is held in the unlocking condition, an improved anchor retrieving device which comprises:

a lock assembly comprising gripper means detachably mounted on an intermediate position of said main anchoring line while gripping said main anchoring line, and a lock lever having a lower part swingingly supported by the lower portion of said gripper means and an upper part releaseably held by said gripper means;

a connection line having one end connected to one end of said shank opposite to said crown end, and a connection line retainer connected to the other end of said connection line, said connection line retainer being fixed to said lock lever in the locking condition and being released from said lock lever in the unlocking condition;

restrainer means detachably fixed on a desired position of said main anchoring line to restrict downward movement of said lock assembly;

a weight slidingly engaging with said main anchoring line and adapted to be dropped downwards along said main anchoring line to impinge said lock assembly when it is desired to change said lock assembly from the locking condition to the unlocking condition prior to the anchor raising operation.

DESCRIPTION OF THE DRAWINGS

In order that the invention can be more clearly understood, presently preferred embodiments thereof will now be described, by way of example, with reference to the accompanying drawings, in which:

FIG. 4 is a view showing the embodiment of FIG. 1 which is mounted on the main anchoring line to be combined with an anchor in the locking condition;

FIG. 5 is a perspective view showing the detailed construction of an example of the restrainer means which is in the form of a rope clip;

FIG. 6A is a perspective view showing the weight just being fitted on the main anchoring line;

FIG. 6B is a view similar to FIG. 6B, showing the weight closed to fit over the main anchoring line to be dropped to impinge the lock assembly of the anchor retrieving device;

DESCRIPTION OF THE PREFERRED EMBODIMENT

Figure 1:
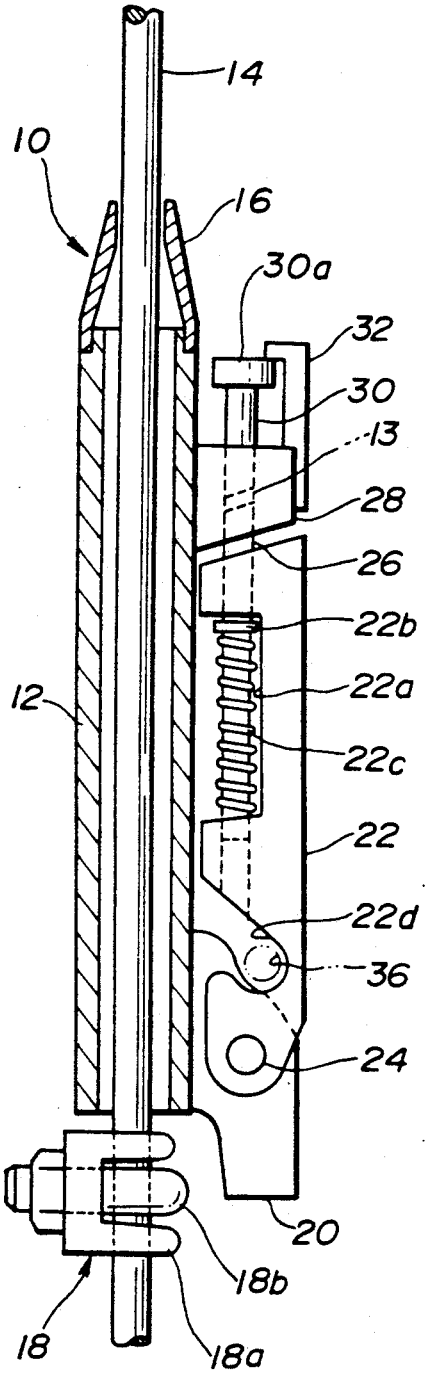
FIG. 1 is a side elevational view, partly in section, of an embodiment of the invention as it is in the locking condition.
Figure 2:
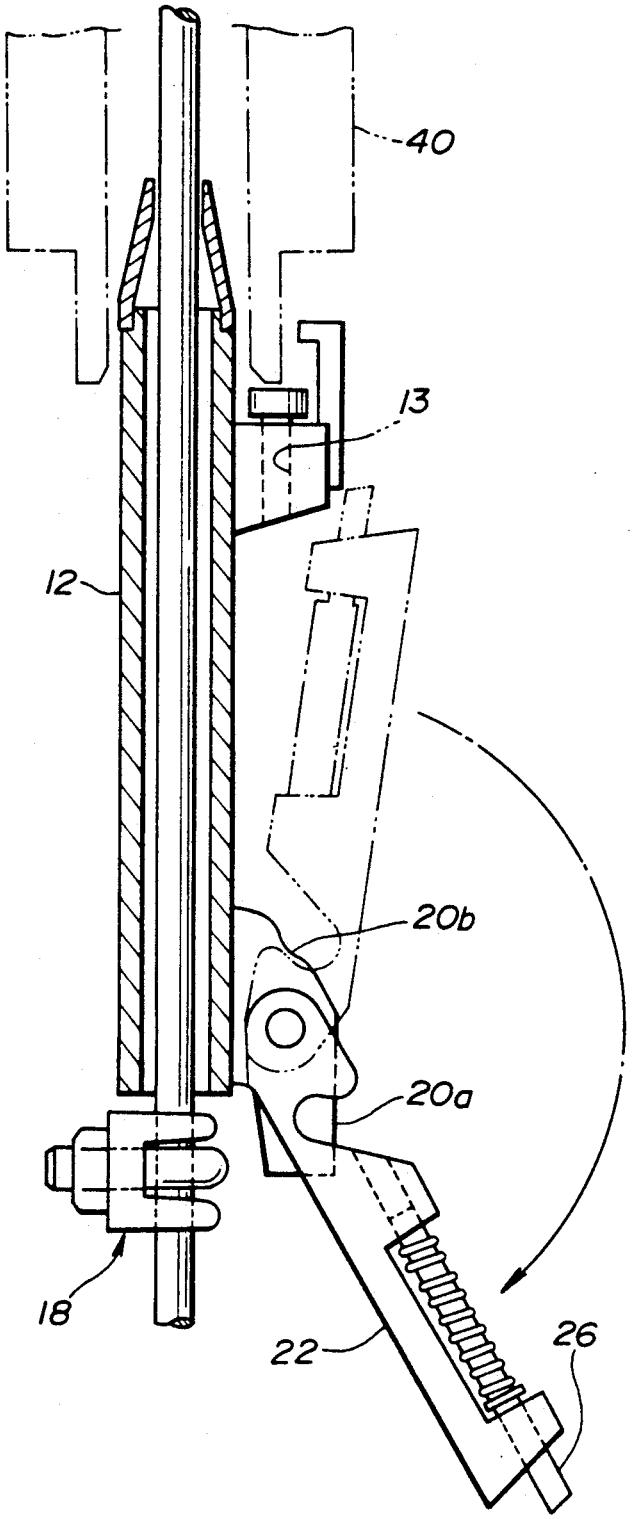
FIG. 2 is a side elevational view of the embodiment of FIG. 1 as it is in the unlocked condition.

The present invention will now be described in detail by referring to preferred embodiments thereof.

A first embodiment is shown in FIGS. 1 to 6. Initially referring to FIGS. 1 and 2, the first embodiment comprises a lock assembly 10 having a gripper means 12 which is made of a metal cylindrical body (i.e. metal pipe) having an inner diameter to pass a main anchoring line 14 therethrough. The main anchoring line 14 passing through the gripper means 12 has a top cap or head 16 of generally frustrum conical shape. The bottom of the gripper means abuts against a rope clip 18, which serves as a restraining means to restrict the downward movement of the gripper means 12. As shown in detail in FIG. 5, the rope clip 18 is composed of a clip body 18*a* having two pairs of legs and a U-shaped bolt 18*b* having the legs extending through the clip body 18*a* to be tightly fixed by nuts.

A lower lug or support 20 extend outwardly and downwardly from the lower portion of the outer periphery of the gripper means 12, and a lock lever 22 is swingingly supported by the lower support lug 20 through a pin 24. The free end or swinging end of the lock lever 22 is releaseably locked to the upper portion of the gripper means 12. In detail, the lock lever 22 has a lock pin 26 biased to protrude beyond the end face of the swinging end. The lock pin 26 is disengageably engaged with another lug 28, which serves as a lock pin receiving lug as will be described in detail hereinafter, integrally fixed to the upper portion of the gripper means 12. The lock pin 26 is biased to protrude beyond the end face of the swinging end of the lock lever 22 by means of a compression spring 22*c* having the lower end seated on the lower face of a spring containing recess 22*a* formed in the body of the lock lever 22 and the upper end engaging with a stopper ring 22*b* fixed around the lock pin 26. The lug 28 has a through-hole or bore 13 extending parallel to the axial direction of the pipe serving as the gripper means 12. The protruding end of the lock pin 26 is received in the lower portion of the bore 13 when the lock assembly is in the locking condition, and the lower end of a knock pin 30 is slidingly inserted in the upper portion of the through-hole 13. The knock pin 30 has an enlarged head 30*a* which abuts against a stopper 32 having a generally J-shaped (or L-shaped) section, so that the knock pin 30 is held in situ without slipping out of the through-hole 13.

When the lock lever 22 is locked by the lock pin receiving lug 28, as shown in FIG. 1, a connection line receiving space 36 for receiving therein a shackle 34*a* serving as a connection line retainer is defined by the U-shaped cut-out 22*d* of the lock lever 22 and the lower lug 20. A portion of the lower lug 20 expands inwardly into the space 36 to form an expanded portion 20*b* which abuts against the shackle 34*a* so that major portion of the anchoring power transmitted from the connection line 34 through a shackle 34*a* is applied to the lock assembly 10 through the expanded portion 20*b* of the lower lug 20.

The lock assembly 10 of the invention is attached to the main anchoring line 14 and the downward movement thereof is restricted by a rope clip 18 fixed at a desired position of the main anchoring line 14 while leaving a predetermined length of the main anchoring line 14 below the rope clip 18. The lower end of the main anchoring line 14 is connected to the crown end of a shank 38*a* of an anchor 38. The connection line 34 extends between the end of the shank 38*a* opposite to the crown end and the connection line receiving space 36, as will be seen from FIGS. 3 and 4. The connection line 34 is a chain in the illustrated embodiment, and has an upper end connected to one end of a shackle 34*a* as a connection line retainer. In the locking condition, i.e. in the normal anchoring condition, the shackle 34*a* is received in or connected to the receiving space 36 defined in the lower portion of the lock lever 22. As shown in FIG. 4, the length of the connection line 34 is determined such that the pulling force from the ship is transmitted through the connection line 34 while the portion of the main anchoring line 14 below the rope clip 18 being in the slackened condition.

Figure 3:
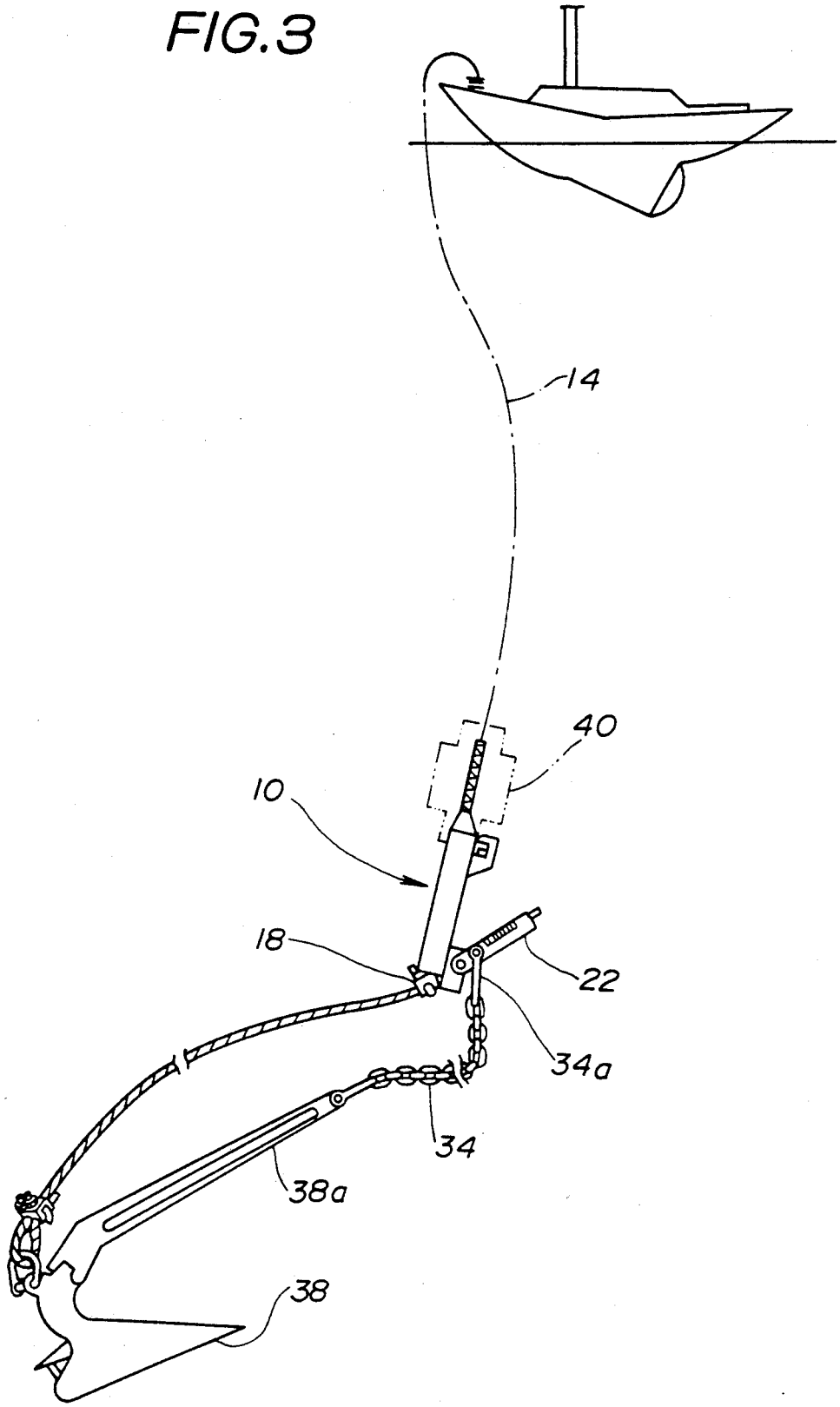
FIG. 3 is a diagrammatical illustration showing the embodiment of FIG. 1 combined with an anchor and just being operated to change from the locking condition to the unlocking condition.

The anchor retrieving device of the embodiment is attached to the main anchoring line 14 in the condition as shown in FIG. 3, and the anchor 38 is dropped into the body of water. In case where the anchor 38 is caught by anything at the bottom of the body of water to be in snagged condition when it is desired to raise the anchor 38 to the ship or boat, a weight 40 is fitted on the main anchoring line 14 and allowed to fall down along the main anchoring line 14. The weight 40 is generally cylindrical, as shown in FIGS. 6A and 6B, and composed of paired half-cylinders splitted and hinged along a line parallel to the axial line of the cylinder. The cylindrical weight 40 is fitted on the main anchoring line 14 under the opened condition as shown in FIG. 6A, and then closed as shown in FIG. 6B with the open ends of the half-cylinders being securedly closed by proper means, such as snap fastener, snap hook or like. The weight 40 released from the hands of the user drops while being guided by the main anchoring line 14 to arrive at the lock assembly 10 of the anchor retrieving device. Whereupon, the head 30*a* of the knock pin 30 is impinged by the bottom peripheral edge of the weight 40 so that the knock pin 30 pushes the lock pin 26 downwards, whereby the lock pin 26 comes out of the through-hole or bore 13. Since a stretching force is applied through the connection line 34, the lock lever 22 is unlocked from the upper lug 28 immediately after the lock pin 26 is released from the bore 13 to swing about the pin 24 (which provides a pivot point for the lock lever 22) in the clockwise direction as viewed in FIG. 2. As a result, the shackle 34*a* of the connection line 34 is released from the connection line receiving space 36. In this operation, the shackle 34*a* is pushed forcibly by the vertical edge 20*a* of the lower lug 20 (see FIG. 2) to come out of the connection line containing space 36 smoothly and reliably.

As the connection line 34 is released from the lock assembly 10, the anchor pulling force is transmitted through the portion of the main anchoring line 14 below the lock assembly 10 so that the anchor 38 is pulled with its crown end held upside. Accordingly, the anchor 38 is easily released from the rock or like which catch the anchor 38 in the snagged condition to be recovered and raised to the ship.

When it is desired to drop the anchor 38 again in a body of water with the anchor retrieving device of the invention in the normal locking condition, the lock assembly 10 may be easily set simply by fixing the end of the shackle 34*a* into the connection line receiving space 36 and then returning the lock lever 22 to the condition, as shown in FIG. 1, at which the lock pin 26 is contained in the bore 13 so that the lock lever 22 is locked by the upper lug 28.

The lower end of the main anchoring line 14 may be connected through a line, which is weaker than the main anchoring line 14, to the crown end of the anchor 38, this weaker line is broken to enable recovery of the lock assembly 10 even when it is impossible to release the anchor 38 from the snagged condition. Although a plow anchor (CQR anchor) is used as the anchor 38 in the illustrated embodiment, other type anchors, such as Danforth anchor, may also be used.

Figure 7:
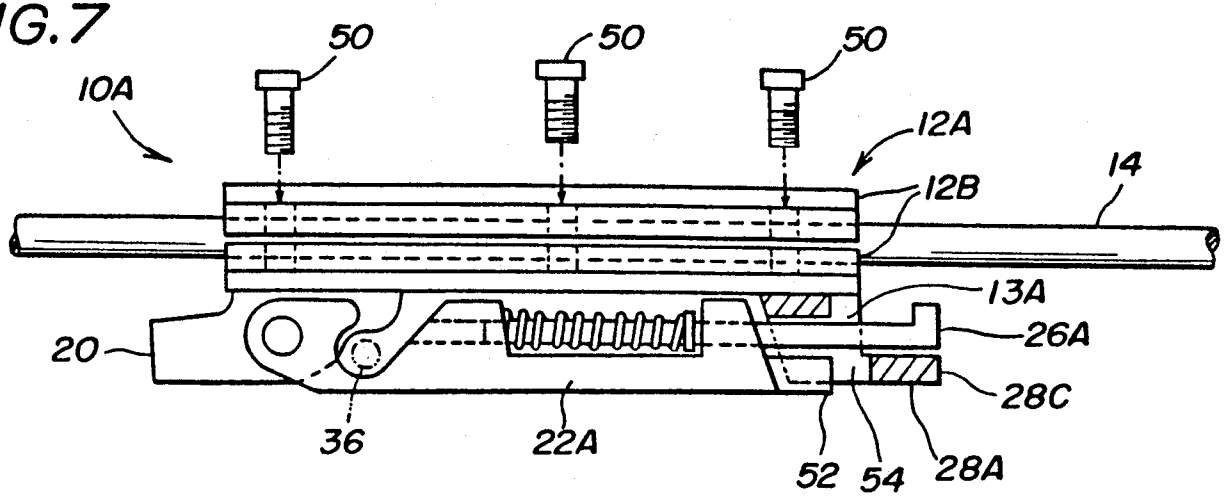
FIG. 7 is an elevational view, partly in section, showing the lock assembly of another embodiment of the invention.
Figure 8:
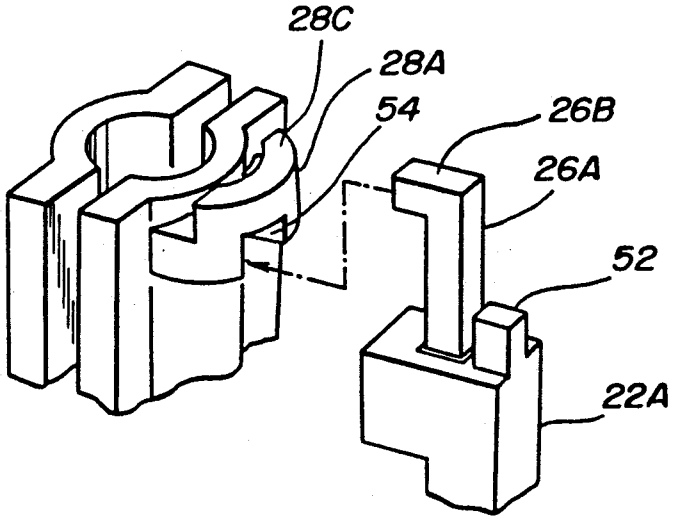
FIG. 8 is a perspective view showing another embodiment of the lock pin receiving lug in the exploded condition.

A lock assembly 10A of a second embodiment of the invention is shown in FIGS. 7 and 8.

In the second embodiment shown in FIGS. 7 and 8, the gripper means 12A is composed of paired half-cylinders 12B, 12B between which the main anchoring line 14 is grasped. These half-cylinders 12B, 12B are clamped by screws or screwed bolts 50 to form a generally cylindrical gripper means 12A. These bolts 50 also serves as the restrainer means for fixing the gripper means 12A at a desired position on the main anchoring line 14 to restrict the movement of the lock assembly 10A. The lock assembly 10A comprises a lock lever 22A having a lock pin 26A, the upper end (the right-hand end as views in FIG. 7) of the lock pin 26A protruding beyond the upper edge (the right-hand edge as viewed in FIG. 7) of the generally cylindrical gripper means 12A. An arcuated ledge 28A is provided on either one of the half-cylinders 12B, 12B, and has an arcuated rising land or bridge 28C (see FIG. 8) which surround the backside or outer side of the lock pin 26A in the assembled condition. As a result, a bore 13A for receiving therein the lock pin 26A is formed between the inner wall of the arcuated ledge 28A and the outer peripheral wall of the half-cylinder 12B. A notch 54 is formed on the bottom of the bridge 28C to receive a joint projection 52 of the lock lever 22A. The lock pin 26A has a bent head 26B having an inverted L-shaped section to ensure that the bottom edge of the weight 40 impinges the lock pin 26A without missing. This second embodiment has an advantage that the concentration of stress applied to the set portion of main anchoring line 14 is alleviated, since the anchor retrieving line 14 is clamped by a relatively large contacting areas of the half-cylinders 12B, 12B, to obviate damage of the portion at which the lock assembly 10 is set.

As will be apparent from the foregoing, the anchor retrieving device of the invention is improved in that it can be attached to a desired position of the main anchoring line without the need of an auxiliary line for connecting the device to the crown end of the anchor. In other words, a portion of the main anchoring line is utilized as the auxiliary line otherwise provided in the device of prior proposal for the recovery of snagged anchor. Accordingly, the connection points for connecting individual lines are reduced to simplify the entire construction and operation. The construction of the device of the invention is further simplified since the knock pin or lock pin impinged by the weight is provided only at either one side of the gripper means.

What is claimed is:

1. In the anchor retrieving device to be combined with a main anchoring line for transmitting the anchoring power to an anchor which includes a shank having a crown end and at least one fluke, said anchor retrieving device transmitting the anchoring power from said main anchoring line to the end of said shank opposite to said crown end when it is held in the locking condition and transmitting the anchor raising power from said main anchoring line to said crown end when it is held in the unlocking condition, an improved anchor retrieving device which comprises:

a lock assembly comprising gripper means detachably mounted on an intermediate position of said main anchoring line while gripping said main anchoring line, and a lock lever having a lower part swingingly supported by the lower portion of said gripper means and an upper part releaseably held by said gripper means;

a connection line having one end connected to one end of said shank opposite to said crown end, and a connection line retainer connected to the other end of said connection line, said connection line retainer being fixed to said lock lever in the locking condition and being released from said lock lever in the unlocking condition, restrainer means detachably fixed on a desired position of said main anchoring line to restrict downward movement of said lock assembly;

a weight slidingly engaging with said main anchoring line and adapted to be dropped downwards along said main anchoring line to impinge said lock assembly when it is desired to change said lock assembly from the locking condition to the unlocking condition prior to the anchor raising operation.

2. The improved anchor retrieving device according to claim 1, wherein said lock lever has a lock pin biased to have one end protruding beyond the swinging end of said lock lever, and wherein said lock assembly further comprises a lock pin receiving lug integrally fixed to said gripper means and having a bore for receiving the protruding end of said lock pin when said lock assembly is in the locking condition, said lock pin being moved downwards to come out of said bore to bring said lock assembly into the unlocked condition upon impingement by said weight.

3. The improved anchor retrieving device according to claim 2, wherein said lock assembly further comprises a knock pin slidingly inserted into the upper portion of said bore of said lock pin receiving lug to be engaged with the top end of said lock pin to push said lock pin downwards when it is impinged by said weight.

4. The improved anchor retrieving device according to claim 1, wherein said connection line retainer is fixed to said lock lever at a point dislocated from the pivot point of said lock lever so that said lock lever is biased to swing in the direction to be released from said gripper means when said lock pin comes out of said bore.

5. The improved anchor retrieving device according to claim 1, wherein said gripper means of said lock assembly has a lower support lug extending from a lower peripheral portion thereof, said lower support lug has an expanded portion which abuts against said connection line retainer to transmit the anchoring power from said connection line to said lock assembly through the lower support lug.

6. The improved anchor retrieving device according to claim 1, wherein said lower support lug has an end edge for ensuring smooth and reliable release of said connection line retainer in the unlocking condition.

7. The improved anchor retrieving device according to claim 1, wherein said restrainer means comprises a rope clip adapted to be fixed at a desired position on said main anchoring line, whereby the movement of said lock assembly toward said anchor is limited as it abuts against said rope clip.

8. The improved anchor retrieving device according to claim 1, wherein said gripper means is a generally cylindrical body through which said main anchoring line passes.

9. The improved anchor retrieving device according to claim 1, wherein said gripper means comprises a pair of half cylinders and said lock assembly is mounted to either one of said half-cylinders, and wherein said restrainer means comprises at least one clamping member for tightly clamping said pair of said half-cylinders together to form said generally cylindrical body and for fixing the formed generally cylindrical body to said main anchoring line.

* * * * *